United States Patent [19]

Silver

[11] 4,343,559

[45] Aug. 10, 1982

[54] RETRACTABLE MECHANISM FOR A WRITING ELEMENT

[75] Inventor: Derrick J. Silver, Letchworth, England

[73] Assignee: Platignum Limited, Great Britain

[21] Appl. No.: 162,991

[22] Filed: Jun. 25, 1980

[30] Foreign Application Priority Data

Jul. 2, 1979 [GB] United Kingdom ..... 7922832
Mar. 3, 1980 [GB] United Kingdom ..... 8007188

[51] Int. Cl.[3] ..... B43K 24/00
[52] U.S. Cl. ..... 401/109; 401/112
[58] Field of Search ..... 401/109, 99, 112, 115

[56] References Cited

U.S. PATENT DOCUMENTS

| | | | |
|---|---|---|---|
| 2,930,356 | 3/1960 | Lignori | 401/113 |
| 3,007,444 | 11/1961 | Lockwood | 401/113 |
| 3,062,191 | 11/1962 | Van Haltern et al. | 401/110 |
| 3,558,234 | 1/1971 | Kranich | 401/112 |

FOREIGN PATENT DOCUMENTS

| | | | |
|---|---|---|---|
| 752166 | 2/1967 | Canada | 401/112 |
| 1145960 | 3/1963 | Fed. Rep. of Germany | 401/109 |
| 1461630 | 11/1969 | Fed. Rep. of Germany | 401/112 |
| 727049 | 3/1955 | United Kingdom | 401/112 |
| 748897 | 5/1956 | United Kingdom | 401/109 |
| 804903 | 11/1958 | United Kingdom | 401/109 |
| 854313 | 11/1960 | United Kingdom | 401/109 |
| 880633 | 10/1961 | United Kingdom | 401/109 |
| 1030568 | 5/1966 | United Kingdom | 401/109 |
| 1052922 | 12/1966 | United Kingdom | 401/109 |
| 1058098 | 2/1967 | United Kingdom | 401/109 |
| 1114900 | 5/1968 | United Kingdom | 401/109 |
| 1255389 | 12/1971 | United Kingdom | 401/109 |
| 1264963 | 2/1[illegible] | United Kingdom | 401/109 |

*Primary Exa[illegible]*—William Pieprz
*Attorney, Agent, or Firm*—Karl W. Flocks; A. Fred Starobin

[57] ABSTRACT

A retractable mechanism for a writing element especially the expendable refill of a ball-point writing pen, is disclosed. A manually depressible plunger (4) advances a latch member (7) biased to retract the plunger (4). The latch member (7) has a pair of latch arms (11,12) one of which in an advanced or retracted position thereof engage a latch means (5,6). Depression of the plunger (4) releases the engaged latch arm (11 or 12) from its latch means (5,6). The resultant of the force on the plunger (4) and bias on the writing element (1) then laterally aligns the other latch arm (12 or 11) with its latch means (6 or 5). On release of the plunger (4), the bias on the writing element (1) brings a co-operating notch (16) and pivot edge (15) of the aligned latch arm (11,12) and latch means (5,6) into register for pivot action therebetween. This pivot action and rocking of the latch member (7) about its fulcrum (9) positions the latch member rearward limb (23) in readiness for the next depression of the plunger (14) whereby the writing element (1) may be displaced between its retracted and projected positions (or vice versa) in response to successive depressions of the plunger (4).

6 Claims, 11 Drawing Figures

18
B
4
13
2
23
3
7
14
5
15
6
12
17
F
11
20
8
10
9
1
A
20
24
19

13
4
13
15
22
3
23
14
5
21
15
17
6
12
G
7
11
8
10
9
20
A
1
24
19

18
4
2
14
3
13
23
21
5
15
15
6
16
12
11
7
24
8
17
9
10
20
A
19
1

18
4
2
B
3
23
13
22
5
14
11
12
F
24
8
7
19
17
10
1
A
19

18
4
2
3
13
22
23
14
5
15
17
16
6
11
15
F
12
8
7
10
20
9
24
A
1

18
4
2
23
22
3
21
14
16
G
12
5
11
17
7
6
8
10
9
15
A
1
24
19

RETRACTABLE MECHANISM FOR A WRITING ELEMENT

BACKGROUND TO THE INVENTION

This invention relates to a retractable mechanism for a writing element.

In well known writing instruments of the ball point type, the writing element comprises a refill which contains the writing fluid and has a writing tip of known ball point construction. Where the writing element is desired to be retractable between an extended position in which the writing tip is projected out of a housing for writing purposes and a retracted position in which the writing tip is retracted wholly within the housing for avoiding the inadvertent transfer of writing fluid, a retractable mechanism is provided.

More especially this invention relates to a retractable mechanism for a writing element comprising a plunger, passage means defining a passage in which said plunger is constrained to move in the longitudinal direction of said passage, a pair of latch means oppositely disposed when viewed in a plane normal to said longitudinal direction, a latch member reciprocally displaceable in said longitudinal direction by means of said plunger, said latch member having a pair of laterally extending latch arms oppositely directed and each disposed for engagement with a respective one of said latch means, one of the latch means defining a forward, projected position of the writing element and the other of the latch means defining a rearward, retracted position of the writing element, when present the writing element is resiliently biased to urge the latch member rearwardly in its longitudinal direction to ensure that one of said abutment means engages with its associated latch means, advance of the plunger in the forward longitudinal direction releasing the engaged one of the abutment means from its latch means whereby the latch member may be displaced laterally to ensure alignment of the other of said abutment means with its associated latch means thereafter to engage therewith whereby the writing element may be displaced between its retracted and projected positions (or vice versa) in response to successive depressions of the plunger. Such a retractable mechanism is referred to herein as a retractable mechanism as hereinbefore defined.

One prior art retractable mechanism disclosed in United Kingdom Pat. No. 804,903 has the features of the retractable mechanism hereinbefore defined. The plunger has a pair of strike faces which alternately on successive depressions of the plunger strike respective ones of two cam faces on the latch member. The latch member has a rearward limb which at its rearward end defines the pair of cam faces individually associated with the plunger strike faces. The rearward limb of the latch member has a pair of latch rockers, or pivots, each of which is a pivot for a fulcrum action of the latch member thereabout when in contact with a respective interior wall portion of the passage. These latch rockers and the cam faces are located on opposite sides of a longitudinal centre line through the rearward limb of the latch member. The rearward limb extends from a base of the latch member having a planar forward bearing surface which seats on an adaptor cap fitted on the rearward end of the writing element and also carries the laterally extending oppostely directed abutment means, which are termed latch arms in that patent. Also in that patent the latch means are termed latch shoulders. In the operation of this prior art retractable mechanism, assuming the mechanism is assembled and operational, one of the latch arms will be in engagement with its respective latch shoulder (say the rearward latch shoulder defining the retracted position of the writing element). With the writing element retracted, the cam face on the side of the latch member remote from the engaged latch arm should be positioned such that, as the plunger is depressed, a respective one of the plunger strike faces strikes that cam face to advance the latch member longitudinally in the passage. This action maintains the latch rocker (or pivot), on the same side of the latch member as the engaged latch arm, in contact with the interior wall of the passage and, as the latch member advances sufficiently to release the engagement between the latch arm and the rearward latch shoulder, the force of the plunger strike face acting on the cam face causes the latch member to pivot about the latch rocker and displace the other latch arm laterally towards the forward latch shoulder which it engages when the plunger advances latch member forwardly below the forward latch shoulder. When the plunger is released, the resilient bias acting on the writing element causes the latch member to pivot at the point of engagement between the latch arm and the forward latch shoulder to bring the other latch rocker into contact with the interior wall of the passage adjacent thereto and thereby align the other cam face (the one nearest to the latch arm engaged with the forward latch shoulder) for contact by its associated plunger strike face on the next depression of the plunger. The next depression of the plunger similarly releases the now engaged latch arm from the forward latch shoulder, and the force of the strike face on the cam face effects pivoting of the latch member about the latch rocker in contact with the passage interior wall resulting in lateral alignment of the other latch arm with the rearward latch shoulder. Thus, the rearward latch shoulder is engaged by its associated latch arm when the plunger is released and the latch member moves rearwardly due to the resilient bias acting on the writing element. After this engagement, the other latch rocker (or pivot) is brought similarly into engagement with the passage interior wall adjacent thereto such that the cam face on the latch member required for the next depression of the plunger is aligned for contact by its respective strike face.

In U.K. Pat. No. 804,903, the correct alignment of the cam faces on the latch member for contact of the required one of them by its associated plunger strike face when the plunger is next depressed is critical to the operation of this retractable mechanism. Likewise, the location of the latch rockers or pivots on the sides of the latch member rearward limb is critical. Furthermore, a high degree of precision of alignment in the assembly of the components is critical to reliable operation of this retractable mechanism. The embodiment illustrated in the patent requires a multiplicity of components which can lead to high material costs, high production labour costs and the problem of high failure rates in an automated assembly situation.

SUMMARY OF THE INVENTION

The present invention seeks to provide a retractable mechanism in which the displacement of the latch member is effected more reliably, more simply and requires simpler and fewer component features. By specifying simpler components or component features, the present invention also seeks to facilitate reliable automated assembly, lower component costs and labour costs, and fewer rejects following post assembly inspection. The present invention specifically seeks to employ a latch member which does not require, during assembly, critical alignment of its rearward limb with respect to its lateral position relative to the plunger.

According to the present invention there is provided a retractable mechanism for a writing element as hereinbefore defined characterised in that the latch member has a rearwardly extending limb with opposite faces configured for linear contact with contiguous portions of the passage interior walls, the plunger contacting the rearward end of the rearward limb on each successive depression thereof, the latch member having fulcrum means at a forward portion thereof for engagement with the writing element (when present), wherein, in use, depression of the plunger advances the latch member with its rearward limb in sliding contact with the passage interior wall contiguous with the last engaged latch means whereby the resultant of the depression force on the plunger and the resilient bias on the writing element laterally displaces latch member such that the abutment means remote from the last engaged latch means is longitudinally aligned with its associated latch means, and thereafter release of the plunger enables the now aligned abutment means and latch means to engage followed by rocking for the latch member about its fulcrum means to place a respective face of the rearwardly extending limb of the latch member in linear contact with that portion of the passage interior wall contiguous with the now engaged latch means thereby positioning the rearwardly extending limb of the latch member in readiness for the next depression of the plunger.

Embodiments of this invention have the advantage that during assembly there is no critical lateral alignment of the latch member relative to the plunger since subsequent contact between the plunger and the latch member merely requires the forward end of the plunger to act on the rearward end of the latch member. Component features and parts are greatly simplified and lend themselves to cost reductions in component materials, simplified and reliable automated assembly and fewer inspection rejections with the economic savings which result.

It is a preferred feature of one embodiment of the invention that each latch means (5,6) and its associated latch arm (11,12) have co-operating means (15,16) to facilitate a pivot action therebetween, and wherein when, following depression of the plunger (4) to release the last engaged latch arm (11,12), the latch member (7) is urged rearwardly then the respective one of the faces (21,22) of the limb (23) moves rearwardly in sliding contact with the co-operating means (15) of a latch means (5,6) thereby laterally positioning the latch member (7) such that the resilient bias (A) acting on the writing element (1) is effective to cause said pivot action between the now engaged latch arm (11 or 12) and latch means (5 or 6). It is important to ensure by the sliding contact of the limb (23) with the co-operating means (15), specifically a pivot edge, that the co-operating means (15,16) are brought into register since this also ensures that the line of action of writing element (1) (due to its resilient bias in the rearward direction) on the latch member (7) is effective to rock the latch member (7) about its fulcrum (9) and effective to bring about the pivot action between the co-operating means (15,16). If this line of action of this force (A) was too near the side wall (of the engaged latch means and latch arm), then the requisite pivot action and rocking of the latch member would not occur.

It is also a feature of the preferred embodiment that the rearwardly extending limb (23) has side faces (21,22) which are linear when viewed in a plane normal to said longitudinal direction, said latch arms (5,6) on by the forward portion (8) of the latch member (7) being arranged laterally of the limb (23) and being configured to define therewith notches (16) for co-operation with pivot edges (15) on the latch means (5,6) to facilitate sliding contact between said pivot edges (15) and the side faces (21,22) to bring said pivot edges (15) and notches (16) into register for pivot action therebetween, and said fulcrum means (9) on said forward portion (8) of the latch member (7) depends below said latch arms (5,6) for engagement with the writing element (1), whereby rearward movement of the writing element caused by the force (A) of its resilient bias brings the pivot edges (15) and notches (16) into register and ensures that the latch member (7) is able to rock about its fulcrum (9).

It is a further feature of the preferred embodiment that the passage defining means (2) and the latch means (5,6) are integral, the latch means (5,6) being arranged at laterally opposite and axially spaced locations at the end of the passage (3) communicating with the latch member (7), the latch member (7) alternately contacting opposite portions (13, 14) of the passage (3) contiguous with respective ones of the latch means (5,6) according to which of its latch arms (11,12) is engaged with a latch means (5,6).

DESCRIPTION OF THE DRAWINGS

Embodiments of the invention will now be described by way of example only, with reference to the accompanying drawings in which.

DETAILED DESCRIPTION OF THE EMBODIMENTS

Figure 1:
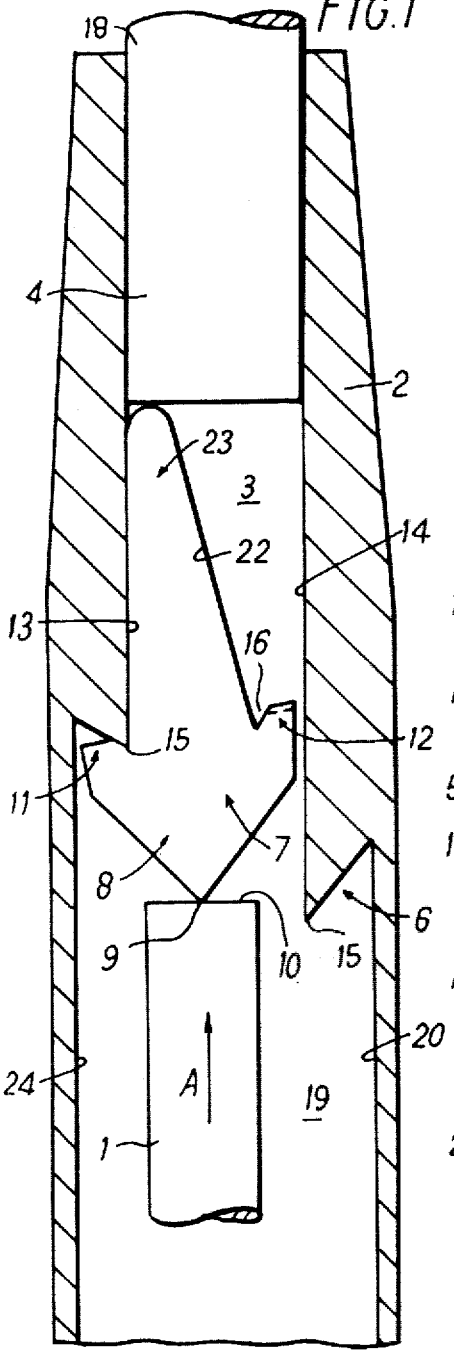
FIG. 1 shows schematically and in elevation, partly in section a retractable mechanism for a writing element in the retracted position of the element.

In FIG. 1 there is shown schematically a retractable mechanism for a writing element 1. Passage defining means 2 define a passage 3 in which a plunger 4 is constrained to move in the longitudinal direction of the passage 3. A pair of latch means 5,6 are oppositely disposed, when viewed in a plane normal to the longitudinal direction of passage 3. These latch means 5,6 are also mutually spaced in the longitudinal direction of passage 3; as will become clear the latch means 5,6 determine advanced or projected and retracted positions of the writing element 1. A latch member 7 is reciprocally displaceable in the longitudinal direction of passage 3 by means of the plunger 4. Latch member 7 has one forward end 8 defining a pivot edge 9 for engagement with the end face 10 of the writing element 1. A pair of latch arms 11,12 extend laterally of the latch member 7 in opposite directions and each of the latch arms 11,12 is disposed for engagement with an associated one of the latch means 5,6.

The writing element 1 is resiliently biased (by means not shown, but see FIG. 9) in the direction of arrow A to urge the latch member 1 in said longitudinal direction until one of the latch arms 11,12 contacts its associated latch means 5,6: as shown in FIG. 1 latch arm 11 contacts latch means 5. The plunger 4 may be advanced against the bias acting on the latch member 7. From the position shown in FIG. 1 an actuating advance of the plunger 4 causes the latch member 7 to be angularly displaced about its pivot edge 9 and about its position of contact with the plunger 4 to the extent necessary for the other of the latch arms 12 to be aligned with its associated latch means 6 (as will be explained below with reference to FIGS. 2 to 5). As will also be explained below, release of the plunger 4 (after an actuating advance thereof) allows the latch arm 12 so aligned to engage its associated latch means 6. This engagement between latch arm 12 and latch means 6 is maintained until a further advance of the plunger 4 is effected.

Figure 4:
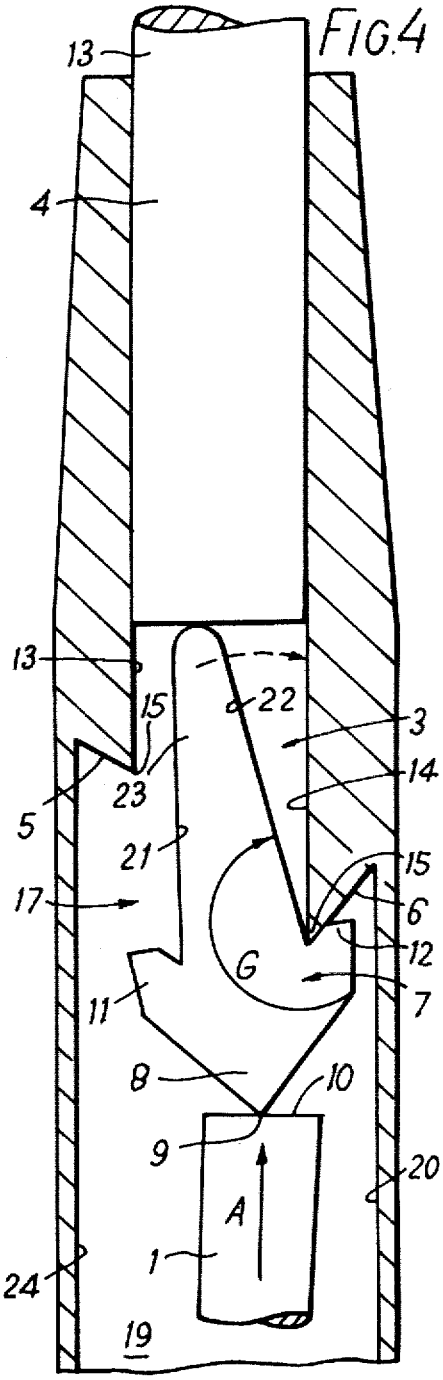
Figure 5:
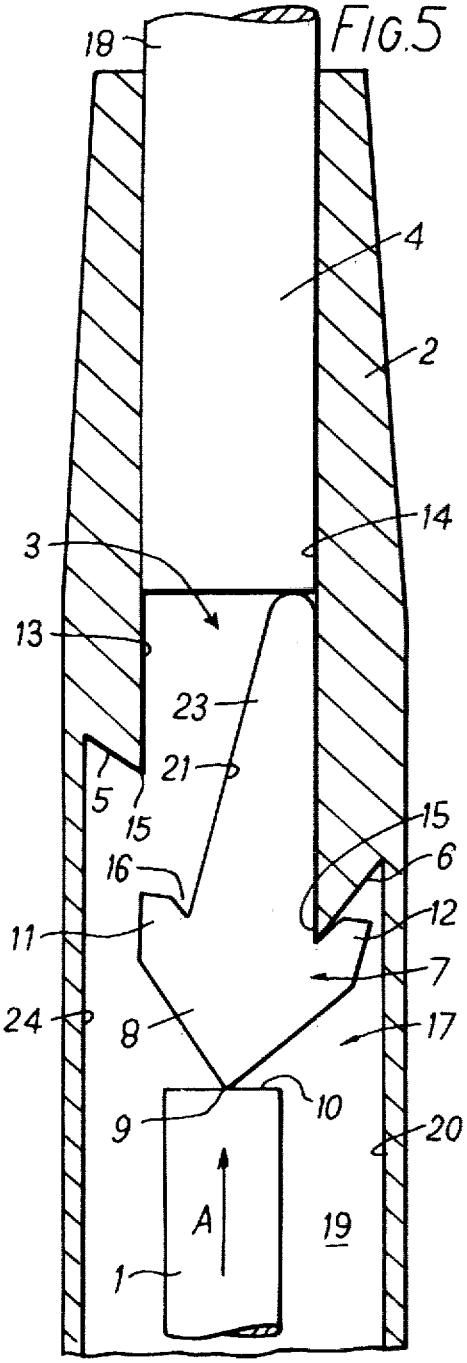

In this embodiment, it is a preferred feature that each latch means 5,6 and its associated latch arm 11,12 is configured to facilitate a pivot action therebetween. After the plunger 4 is retracted, under the influence of the bias acting on latch member 7, to the extent that one of the latch arms 6 engages its associated latch means 12 (as in FIG. 4), pivot action of the latch member 7 is initiated and continues until the latch member 7 abuts that portion 14 of the passage 3 contiguous with the latch means 6 (FIG. 5). In this embodiment, the latch means 5,6 each define a pivot edge 15 and the latch arms 11,12 each define a notch 16 for line contact with the respective pivot edge 15 about which line contact the pivot edge 15 executes this pivot action.

As shown in FIG. 1, the passage defining means 2 and the latch means 5,6 are integral and form part of a casing for the retractable mechanism. The latch means 5,6 are arranged at laterally opposite and axially spaced locations at the end 17 of the passage 3 communicating with the latch member 7. The latch member 7 alternately contacts (FIGS. 1 and 5) opposite portions 13, 14 of the passage 3 continguous with respective ones of the latch means 5,6 according to which of its latch arms 11,12 is engaged with a latch means 5,6.

Figure 2:
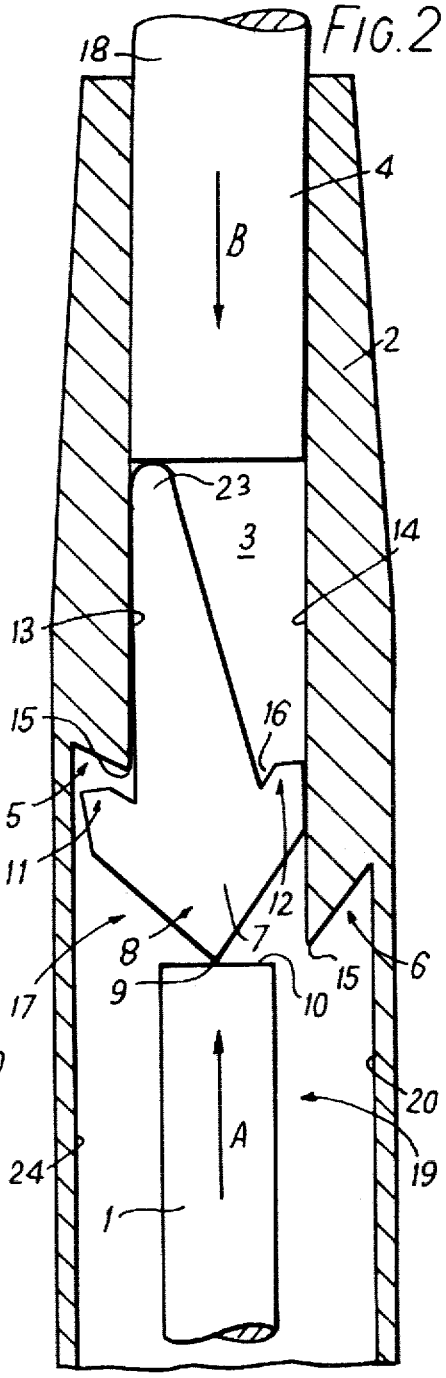
FIGS. 2 to 5 show diagrammatically the operation of the retractable mechanism in transferring the writing element from the retracted position of the member in FIG. 1 to the advanced position of the member in FIG. 5.
Figure 3:
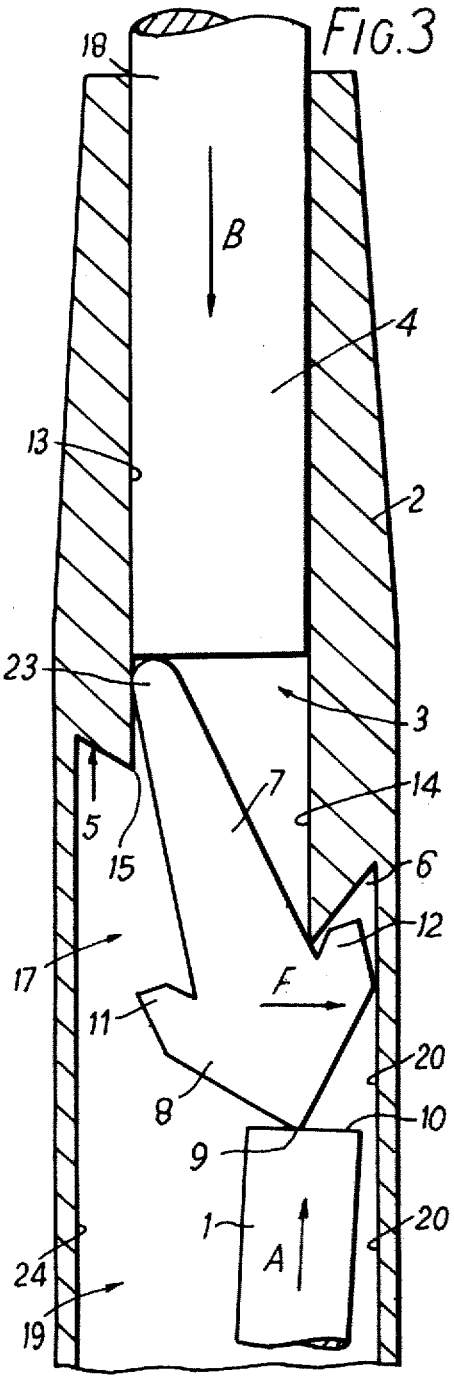

The operation of the retracted mechanism in transferring the writing element 1 between the retractable position of the member in FIG. 1 and the advanced position of the member in FIG. 5 will now be described. With the mechanism in its FIG. 1 attitude, the plunger 4 is advanced by a force applied to the end thereof 18 which extends outside the passage 3. This force overcomes the bias acting on the latch member 7 and causes plunger 4, latch member 7 and writing element 1 to advance in direction of arrow B (FIG. 2). This advance initially releases the latch means 11 from the latch arm 5. The forces A & B are not co-linearly directed, but rather act along separate, spaced longitudinally extending paths with respect to the passage 3. This gives rise to a couple which results in a force (FIG. 3) in the direction of arrow F. Until latch arm 12 passes longitudinally below the latch means 6, the force F simply urges the latch member 7 laterally of the passage 3 to maintain contact between the passage wall 14 and the latch member 7. Continued advance of the plunger 4 causes the latch member 7 to advance to a position in which the latch arm 12 is longitudinally below the latch means 6 (FIG. 3). As the latch member 7 advances further (downwardly in FIG. 2), the latch member 7 no longer contacts the passage wall 14 and in consequence the force F urges the latch member 7 laterally across the cavity 19 towards a position in which the latch arm 12 is below the latch means 6 and contacts the side wall 20. As the latch member 7 effects this lateral displacement, this displacement is accompanied by a pivoting action of the rearwardly extending limb 23 of the latch member 7 about its position of contact with the plunger 4. In addition, during the lateral displacement of the latch member 7, displacement of the upper end 10 of the writing element 1 towards the side wall 20 also occurs (as shown in FIG. 3). This displacement of the upper end 10 is possible if the writing element 1 is flexible (as in the case of some refills of writing instruments) and also if the mounting of a rigid writing element 1 (which is not shown and which is at the end of member 1 remote from end 10) is such as to allow tilting of the member 1.

When after advancing plunger 4 to position the latch member 7 with the latch arm 12 longitudinally below the latch means 6, the plunger 4 is released, then the bias acting on writing element 1 causes the writing element 1 to urge the latch member 7 upwardly until, as shown in FIG. 3, the latch arm 12 contacts the latch means 6 and engages therewith. This engagement is retained until plunger 4 is next advanced.

In this preferred embodiment, latch arm 12 is provided with notch 16 which engages in line contact with a pivot edge 15 on the undercut latch means 6. This facilitates pivot action of the latch member 7 about the pivot edge 15 as illustrated in FIG. 4. The pivot action about pivot edge 15 results from the bias acting upwardly on the writing element 1 which is also applied to the latch member 7 and creates the couple G. In consequence, latch member 7 continues to pivot about the pivot edge 15 until contacting the portion 14 of the passage 3 contiguous with the latch means 6, as shown in FIG. 5.

The rearward movement of the latch member 7 is accompanied by the pivot edge 9 moving away from the side wall 20 in the cavity 19. As may be seen from FIGS. 1 and 5, the latch member 7 is contoured at its upper side faces 21, 22 for linear contact with the portions 13, 14 of passage 3 in its retracted and advanced attitudes shown in these Figures. This configuration of the side faces 21, 22 of the latch member 7 on the limb 23 leads to the limb 23 having a substantially triangular section as seen in FIGS. 1 to 5. Limb 23 and pivot end 8 are longitudinally oppositely disposed on latch member 7 relative to latch arms 11, 12.

It is important to note that, as the latch member 7 moves rearwardly from its FIG. 3 position to its FIG. 4 position, sliding contact between the pivot edge 15 and the side face 22 of the limb 23 ensures that the latch member 7 moves laterally to a position in which the pivot edge 15 and notch 16 are in register for subsequent pivot action therebetween. Furthermore, this lateral movement of the latch member 7 ensures that the resilient bias acting on the writing element is effective to cause the requisite pivot action between the now engaged latch arms 12 and latch means 6. In addition this is then accompanied by rocking of the latch member 7 about its fulcrum means 9. This places the side face 22 of limb 23 in linear contact with the passage portion 14 contiguous with the latch means 6 thereby positioning the limb 23 of the latch member 7 in readiness for the next depression of the plunger 4. The plunger 4 returns to its rearward position due to the bias acting on the writing element 1. It is possible to bias the plunger 4 so that, when released, it returns under its own bias to its rearward position.

Figure 6:
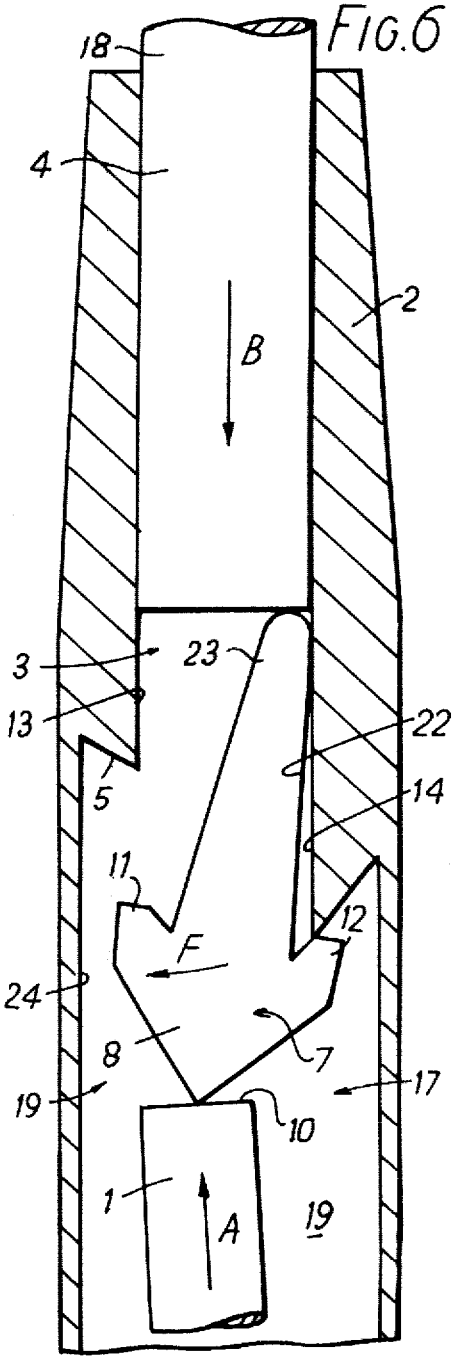
FIGS. 6 to 8 show diagrammatically the operation of the retractable mechanism transferring the writing element from the advanced position of FIG. 5 to the retracted position of FIG. 1.
Figure 7:
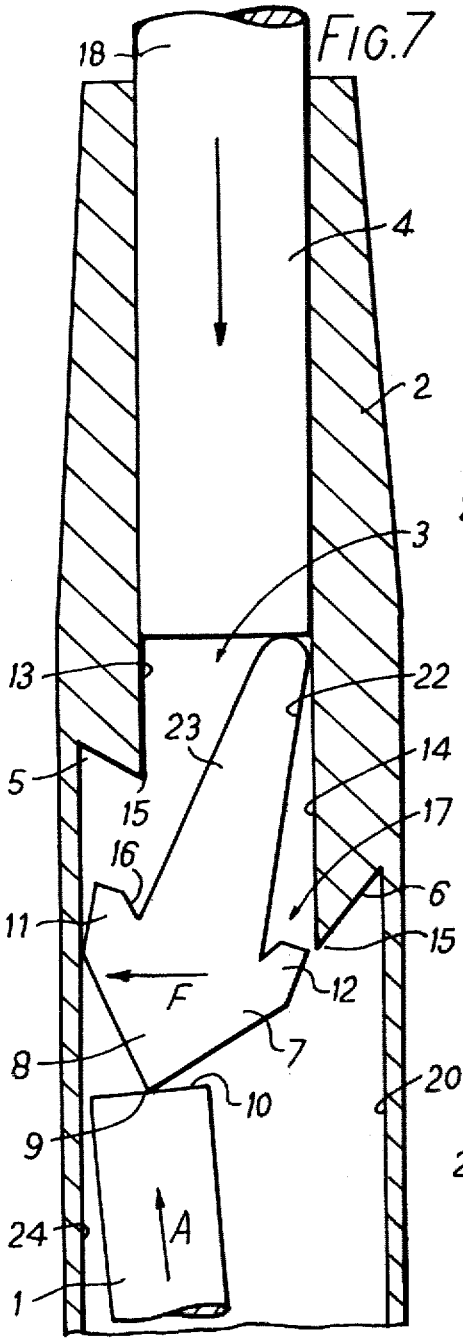
Figure 8:
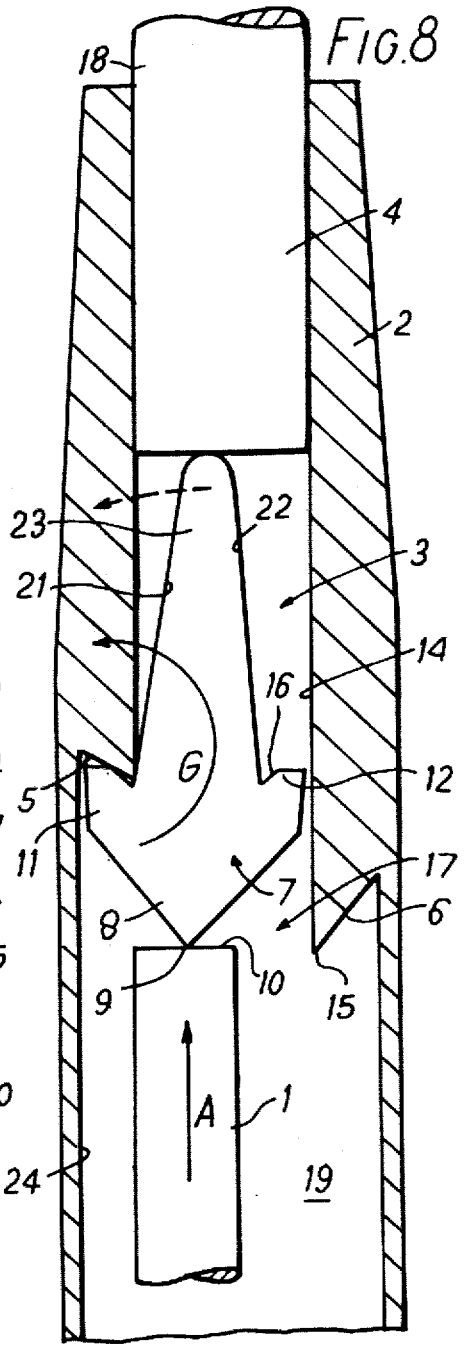

The operation of the retractable mechanism in transferring the writing element 1 from the advanced position of FIG. 5 to the retracted position of FIG. 1 will now be described also referring to FIGS. 6 to 8. This operation is analoguous to that described above for the advance of the writing element 1. FIG. 6 shows schematically the release of the latch arm 12 from the latch means 6 as it is about to occur with the plunger 4 being urged in the direction of arrow B. At the same time, force F urges latch member 7 towards side wall 24 of cavity 19 aligning latch arm 11 with latch means 5. Contact between the latch member 7 and side wall 24 occurs with the plunger 4 depressed as shown in FIG. 7. At this point, limb 23 is still in contact with passage portion 14. On release of the plunger 4, the bias acting on the writing element 1 causes the latch member 7 to be urged upwardly until latch arm 11 contacts and engages latch means 5 (FIG. 8). During this movement, as the latch member 7 contacts side wall 24 the upwardly directed bias force A also tends to rotate the latch member 7 in the sense urging limb 23 towards passage portion 13. As shown in FIG. 8, when the latch arm 11 with its notch 16 engages pivot edge 15 of latch means 5, the couple G causes limb 23 to pivot about pivot edge 15. This pivot action continues until side portion 21 of limb 23 contacts wall portion 13 of passage 3 in the retracted position of the writing element 1 shown in FIG. 1. Again, the engagement between latch arm 11 and latch means 5 is maintained due to the bias on element 1 until plunger 4 is next advanced. Also pivot edge 9 is moved away from the side wall 24 from its FIG. 8 position to its FIG. 1 position.

Figure 9:
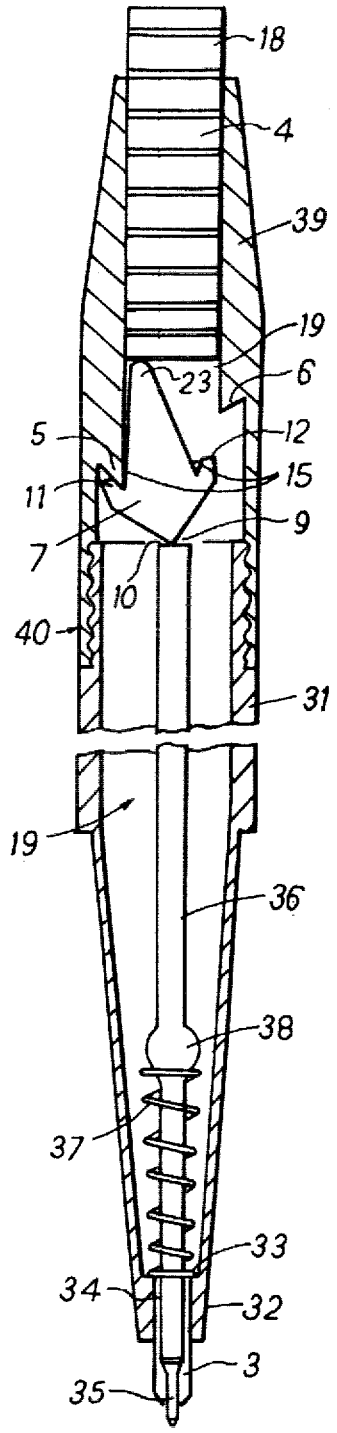
FIG. 9 shows a writing instrument incorporating a retractable mechanism according to the embodiment of FIG. 1.

A writing instrument incorporating the retractable mechanism of FIG. 1 is shown in FIG. 9 which is an elevational view, partly in section of a ball-point pen. The pen has a hollow casing 31 which is provided at its forward end 32 with an internal shoulder 33 and a bore 34 of reduced diameter with respect to the hollow interior 19 of the casing 31. The bore 34 is of a suitable diameter for a ball-point refill 36 to be slidingly displaced therein for the purpose of displacing a tip portion 35 between its retracted position and its advanced writing position.

The refill 36 is resiliently biased towards its retracted position by means of a spring 37 which bears upon the shoulder 33 and a crimp 38 on the refill 36. The refill 36 is restrained from further displacement towards the top of the casing 31 by contact with the pivot edge 9 on the latch member 7 of the retractable mechanism. Since the retractable mechanism is that of FIG. 1, the same reference numerals are employed for like parts in FIG. 9 and a complete description of its structure and operation will not be repeated. The casing 31 is provided with a hollow closure member 39 which is threadedly connected thereto at 40. The plunger 4 of the retractable mechanism is located in a passage 3 of the closure member 39 and by known conventional means not shown, is retained within the passage 3. Assembly of the ball-point pen requires the spring 3 and refill 36 to be placed in the casing 31. The plunger 4 is then arranged in the closure member 39. Then the latch member 7 is placed in the passage 3. The latch member 7 will automatically take up its correct position in use and no particular lateral alignment is required at this assembly stage which represents a significant advantage over the prior art mechanism. Finally, the casing member 31 and closure member 39 are threadedly connected together.

Figure 10A:
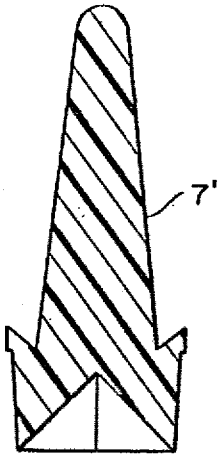
FIGS. 10A and 10B show a section in elevation and a bottom or transverse view looking from the forward end respectively of a second embodiment of a latch member of the present invention.
Figure 10B:
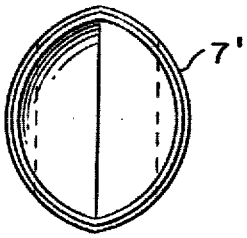

In the aforegoing embodiment of the retractable mechanism of FIGS. 1 to 8, the latch member 7 is shown to be provided with a pivot edge 9 which rests on the face 10 at the end of the refill 36. The pivot edge 9 provides fulcrum means for pivot action of the latch member 7 about the end face 10 of the refill 36. In a modification shown in FIGS. 10A and 10B, the latch member 7' may be provided with a recess to receive the upper end of the refill 36. The recess may be formed by a cavity having faces defining a dihedral angle. Such a recess will enable the latch member 7' to perform its required pivot action about the end of the refill.

I claim:

1. A retractable mechanism for a writing element comprising a casing including a passage extending longitudinally therethrough and walls bounding said passage, a plunger constrained to move in the longitudinal direction of said passage, a pair of latch formations oppositely disposed on said walls of said passage when viewed in a plane normal to the longitudinal direction of said passage, a latch member reciprocally displaceable in the longitudinal direction of said passage by said plunger, a pair of laterally extending latch arms on said latch member oppositely directed and each disposed for engagement with a respective one of said latch formations, one of said latch formations defining a forward projected position of the writing element and the other of said latch formations defining a rearward retracted position of the writing element, a rearward extending limb on said latch member having faces extending convergently from said latch arms towards the rearward end of said latch member, a forward end of said plunger contacting the rearward end of said limb upon a successive depression of said plunger into said passage, said forward end of said plunger having a linear surface generally normal to the direction of depression and allowing freedom of lateral movement of said rearward end of said limb over said surface, a pivot means at a forward portion of said latch member for engagement with a rearward portion of the writing element, resilient bias means moving the writing element to produce a force on said pivot means laterally displaced from a force transmitted to said limb by said plunger when said plunger is depressed, said plunger movable longitudinally forward a distance to move said latch member to release a said latch arm from an engaged said latch formation and position the other of said latch arms forward of the other of said latch formations, said resilient bias means producing its said force sufficiently laterally displaced from said force from said plunger to move said latch member about said pivot means laterally to align said other of said latch arms with said other of said latch formations, a point on each said latch formation for contact with a point on each said latch arm upon engagement of one of said latch arms with a respective one of said latch formations upon release of said plunger, with said points acting as a fulcrum about which said latch member moves, moving said rearward end of said limb laterally over said unobstructed surface of said plunger and moving a said converging face of said latch member against said wall of said passage contiguous with said engaged latch formation with said converging face of said latch member placed in sliding contact with said wall of said passage for a successive depression of said plunger.

2. A retractable mechanism as claimed in claim 1, wherein each said latch formation and its associated latch arm have co-operating pivot means to facilitate said pivot action therebetween, and wherein when, following depression of the plunger to release the last engaged latch arm, the latch member is urged rearwardly then the respective one of the faces of the limb moves rearwardly in sliding contact with the co-operating means of a latch formation thereby laterally positioning the latch member such that the resilient bias acting on the writing element is effective to cause said pivot action between the now engaged latch arm and latch formation.

3. A retractable mechanism as claimed in claim 1, wherein said latch arms on the forward portion of the latch member being arranged laterally of the limb and are configured to define therewith notches for co-operation with pivot edges on the latch formations to facilitate sliding contact between said pivot edges and the side faces to bring said pivot edges and notches into register for pivot action therebetween, and said pivot means on said forward portion of the latch member depends below said latch arms for engagement with the writing element, whereby rearward movement of the writing element caused by the force of its resilient bias brings the pivot edges and notches into register and ensures that the latch arm pivots about its latch formation.

4. A retractable mechanism as defined in claim 1, wherein said latch member has a recess therein defining said pivot means adapted for cooperation with a rearward end of the writing element whereby said latch member is pivotable about the rearward end of the writing element.

5. A retractable mechanism as claimed in claim 1, wherein each latch formation and its associated latch arm have co-operating means to facilitate a pivot action therebetween, wherein after the plunger retracts to the extent that one of said latch arms engages its associated latch formation, angular displacement of the latch member is initiated and continues until the a said convergent face abuts that portion of the passage contiguous with the respective one of the latch formations.

6. A retractable mechanism as claimed in claim 1, wherein the pivot means of the latch member comprises means for pivotal contact with one end of the writing element.

* * * * *